US008397541B1

(12) United States Patent
Chen et al.

(10) Patent No.: US 8,397,541 B1
(45) Date of Patent: Mar. 19, 2013

(54) SINKER CONTROL APPARATUS FOR FLAT KNITTING MACHINES

(75) Inventors: Yi Chen Chen, New Taipei (TW); Kai Ying Cheng, New Taipei (TW); Jian-Hao Peng, New Taipei (TW)

(73) Assignee: Pai Lung Machinery Mill Co., Ltd., New Taipei (TW)

( * ) Notice: Subject to any disclaimer, the term of this patent is extended or adjusted under 35 U.S.C. 154(b) by 31 days.

(21) Appl. No.: 13/236,277

(22) Filed: Sep. 19, 2011

(51) Int. Cl.
*D04B 15/36* (2006.01)

(52) U.S. Cl. ..... 66/75.2; 66/6 R; 66/78; 66/106; 66/109

(58) Field of Classification Search ..... 66/60 R, 66/75.1, 75.2, 78, 104, 106, 109
See application file for complete search history.

(56) References Cited

U.S. PATENT DOCUMENTS 4,109,491 A * 8/1978 Schmid et al. ..... 66/125 R
4,713,948 A * 12/1987 Schmidt et al. ..... 66/106
5,475,990 A 12/1995 Schmid et al.
5,884,505 A * 3/1999 Shima ..... 66/64
6,240,749 B1 * 6/2001 Stoll et al. ..... 66/60 R

FOREIGN PATENT DOCUMENTS

CN 1544739 11/2004
CN 201288244 8/2009
DE 3917934 A1 * 12/1989
TW 446016 7/2001

* cited by examiner

*Primary Examiner* — Danny Worrell
(74) *Attorney, Agent, or Firm* — Muncy, Geissler, Olds & Lowe, PLLC

(57) ABSTRACT

A sinker control apparatus for flat knitting machines located on a transverse board over a plurality of knitting needles to drive parallel sinkers hinged between the knitting needles to rotate. The sinker control apparatus includes a base, a linked movement portion located on the base to perform driving movements, a first control cam and a second control cam hinged on the linked movement portion, and a switching portion coupled with the linked movement portion. The switching portion includes at least one connection rod connecting to the linked movement portion, a switching seat coupled on the connection rod and an elastic element coupled around the connection rod to provide a butting force to the switching seat towards the transverse board. The switching seat has a magnetic attracting portion at one side facing the transverse board to attract the transverse board magnetically.

10 Claims, 7 Drawing Sheets

SINKER CONTROL APPARATUS FOR FLAT KNITTING MACHINES

FIELD OF THE INVENTION

The present invention relates to a sinker control apparatus and particularly to a sinker control apparatus for flat knitting machines.

BACKGROUND OF THE INVENTION

In a conventional flat knitting machine a sinker between knitting needles is employed to control a yarn threaded through a knitting needle in loop releasing, loop coupling, loop escaping and loop forming processes. The sinker has a protrusive edge at one side corresponding to the knitting needle head. When the sinker is rotated the protrusive edge presses the yarn picked up by the knitting needle to form a loop, thereby to form a pattern on the surface of the knitting fabric.

To control rotation of the sinker a control portion is provided at one side of the sinker in the flat knitting machine. For instance, U.S. Pat. No. 5,475,990 discloses a sinker control actuator which includes a first cam and a second cam positioned next to each other. The first and second cams are braced respectively by a first parallel bar and second parallel bar on a mounting rod. The cams are linked via an auxiliary bar. The first parallel bar, second parallel bar and auxiliary bar are linked in movements to control motions of the first and second cams, thereby to push the sinker on the first and second cams to change the rotation angle to form different sizes of loops. Reference of other linked movement structures can also be found in R.O.C. patent TW 446016, China patent publication No. 201288244 and China patent CN1544739.

The conventional first cam and second cam is swung by a switching member linked thereon. The switching member switches positions via a friction force or magnetic force with a needle bed, thereby drives the first and second cams swinging. The distance between the switching member and needle bed is constant. Hence flatness of the needle bed is important. Too great of the distance makes switching impossible, and too small of the distance increases the friction force between the switching member and needle bed that could latch the switching member on the needle bed.

SUMMARY OF THE INVENTION

The primary object of the present invention is to overcome the problem of the conventional sinker control apparatus that could cause unsmooth switching during movements relative to the needle bed.

To achieve the foregoing object the present invention provides a sinker control apparatus for flat knitting machines that is located on a transverse board over a plurality of knitting needles to drive parallel sinkers hinged between the knitting needles to rotate. The sinker control apparatus includes a base, a linked movement portion located on the base to perform driving movements, a first control cam and a second control cam hinged on the linked movement portion, and a switching portion coupled with the linked movement portion. The first control cam and second control cam include a sunk position to drive the sinkers to rotate and a return position to restore the sinkers when the linked movement portion performs the driving movements. The switching portion includes at least one connection rod connecting to the linked movement portion, a switching seat coupled on the connection rod, and an elastic element coupled around the connection rod to provide a butting force to push the switching seat towards the transverse board. The switching seat has a magnetic attracting portion at one side facing the transverse board to attract the transverse board magnetically.

In one embodiment the base has at least one slot run through by the connection rod to couple with the linked movement portion and switching seat.

In one embodiment the first control cam and second control cam have respectively a first driving rod and a second driving rod, and the linked movement portion has a first guide track and a second guide track run through respectively by the first driving rod and second driving rod to guide movements thereof to switch the first and second control cams between the sunk position and return position.

In one embodiment the first guide track has a first pushing section to push the first driving rod to move the first control cam to the sunk position, and a first restoring section to draw the first driving rod to move the first control cam to the return position; the first pushing section and first restoring section are not located on the same plane.

In one embodiment the second guide track has a second pushing section to push the second driving rod to move the second control cam to the sunk position, and a second restoring section to draw the second driving rod to move the second control cam to the return position; the second pushing section and second restoring section are not located on the same plane.

In one embodiment the switching seat has a trough to hold the magnetic attracting portion.

In one embodiment the elastic element includes a first end butting the switching seat and a second end butting the linked movement portion.

In one embodiment the magnetic attracting portion is a magnet.

In one embodiment the elastic element is a spring coupled around the connection rod.

In one embodiment the base has at least one restricting portion to restrict the driving movements of the linked movement portion.

The sinker control apparatus of the invention provides a butting force through an elastic element to the switching seat in the direction of the transverse board to keep a desired contact relationship between the switching seat and transverse board, thereby can stabilize movement conditions of the sinker control apparatus relative to the transverse board, and effectively control the cams to switch between the sunk position and return position.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
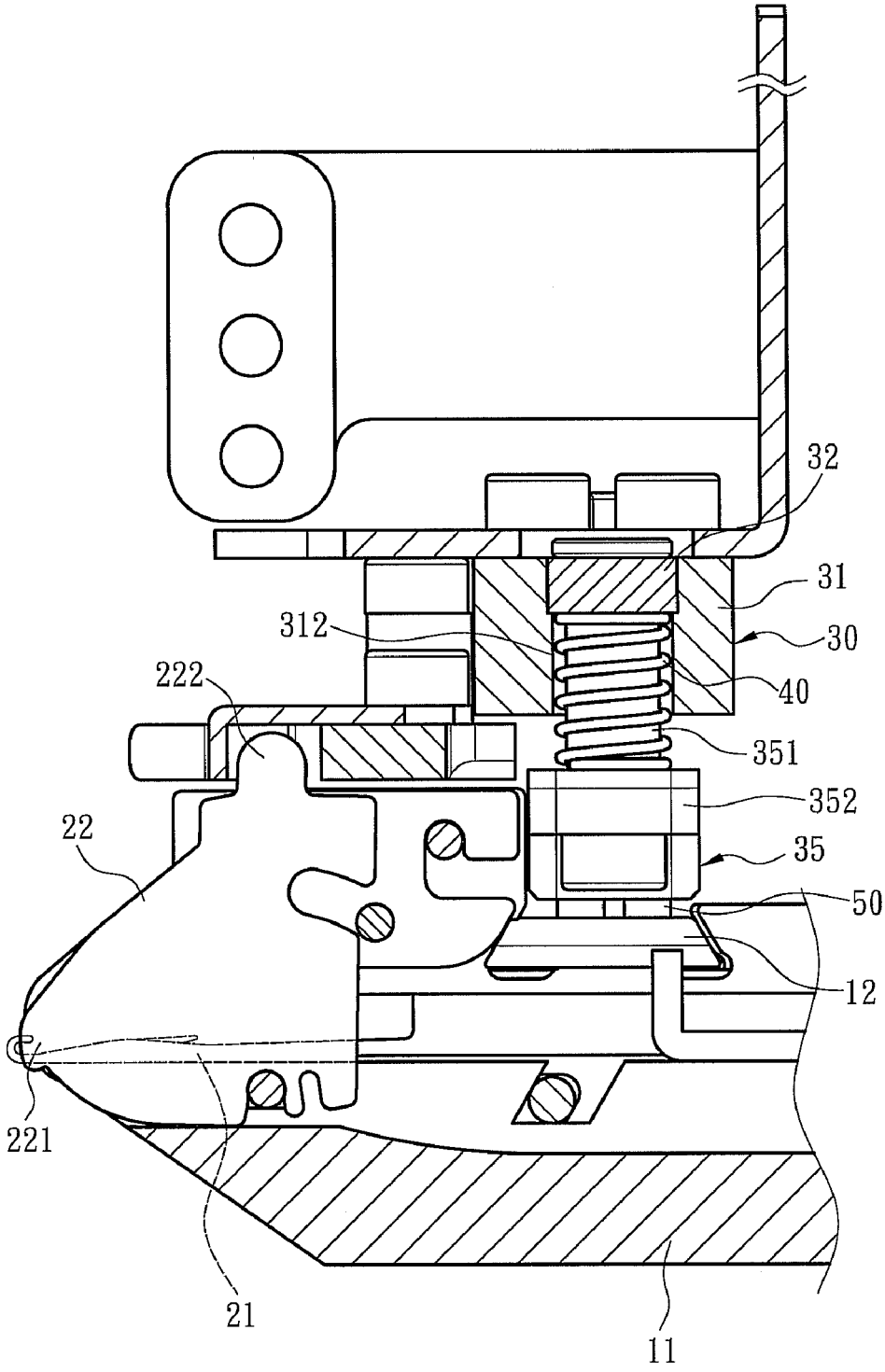
FIG. 1 is a fragmentary side view of an embodiment of the invention adopted for use on a flat knitting machine.

Please refer to FIG. 1 for an embodiment of the invention adopted for use on a flat knitting machine. The sinker control apparatus 30 of the invention is located on a flat knitting machine. The flat knitting machine includes a needle bed 11 and a carrier (not shown in the drawings) movable transversely and reciprocally relative to the needle bed 11. The needle bed 11 holds a plurality of knitting needles 21 parallel with each other and perpendicular to the moving direction of the carrier. Each knitting needle 21 is paired with a sinker 22 hinged to receive a force to rotate. The sinker 22 has a downward pressing boss 221 and a control boss 222. A transverse board 12 is provided over the knitting needles 21 to position the knitting needles 21 on the needle bed 11.

Figure 2:
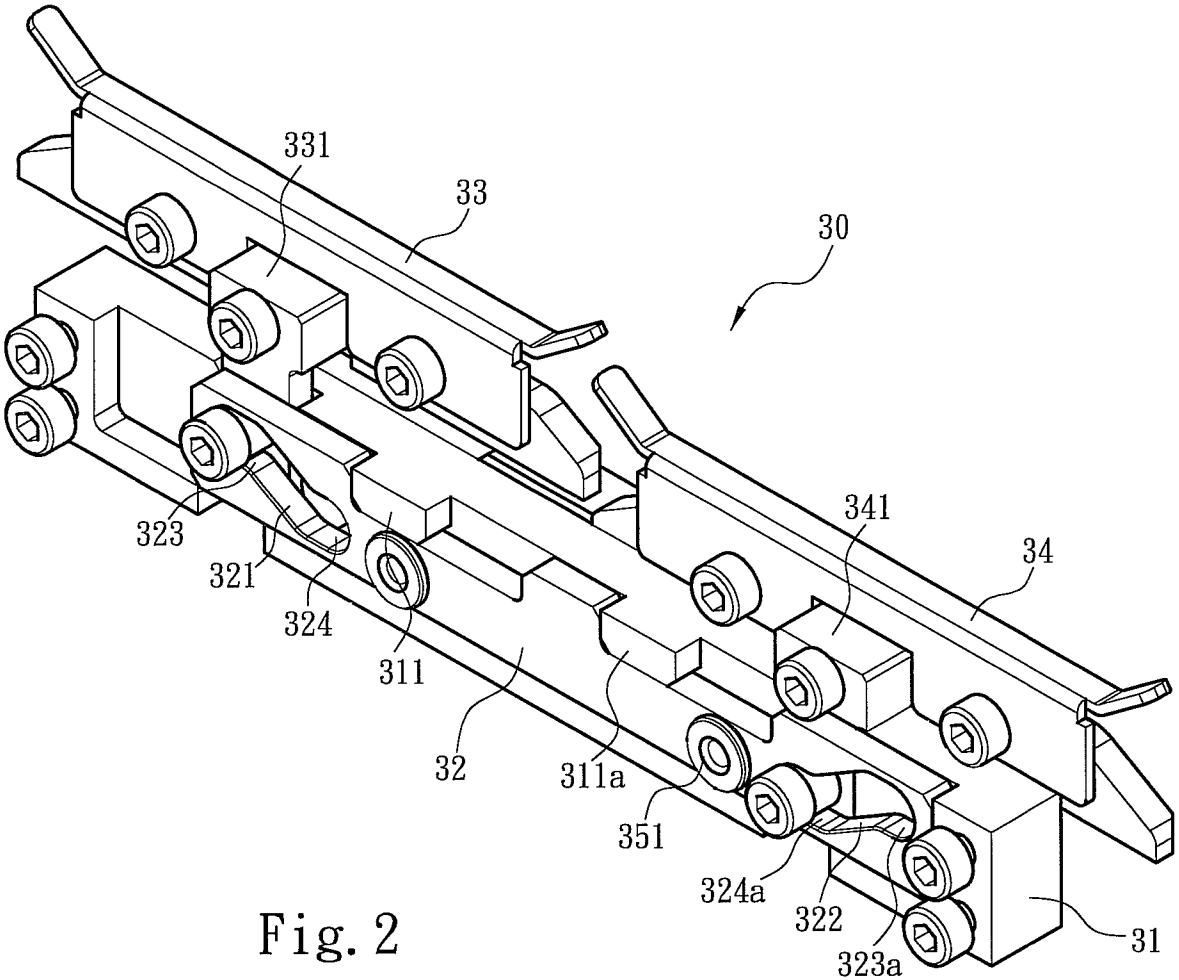
FIG. 2 is a perspective view of an embodiment of the invention.
Figure 3:
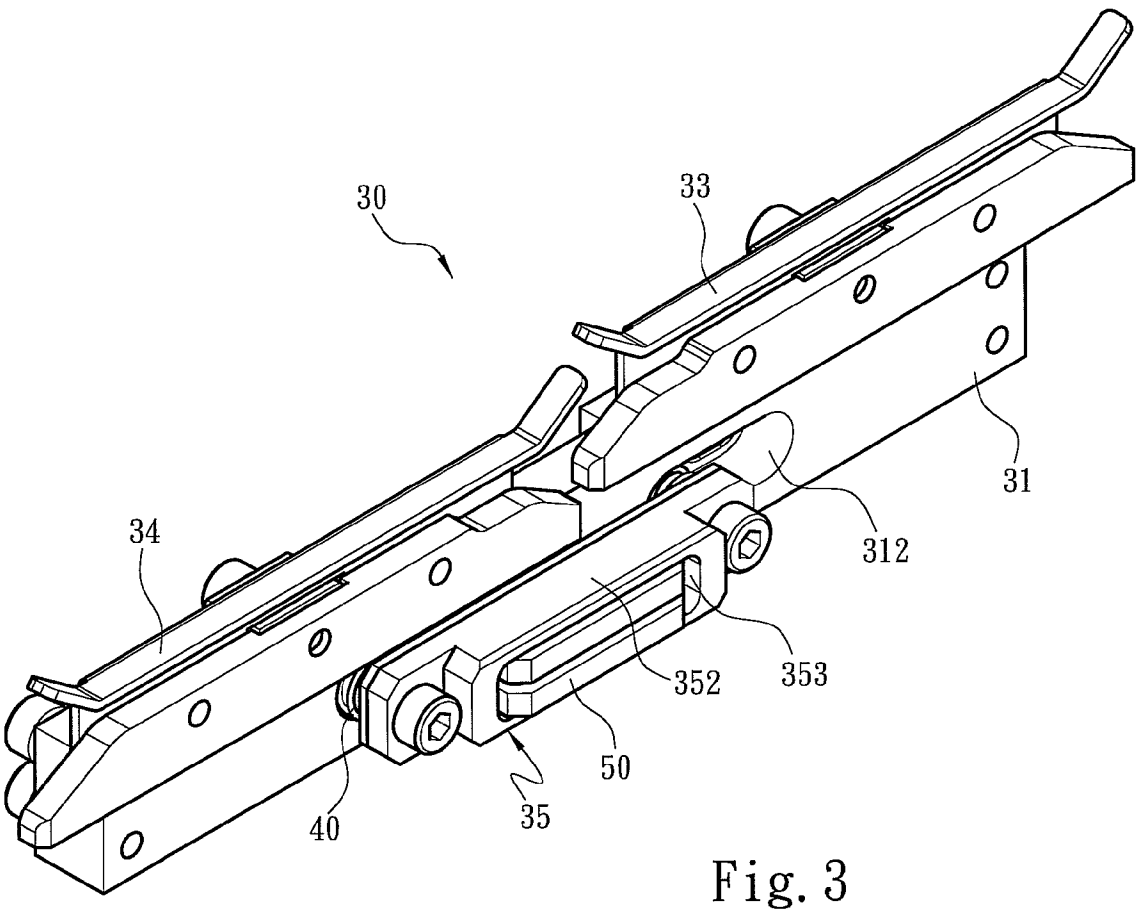
FIG. 3 is another perspective view of an embodiment of the invention.
Figure 4:
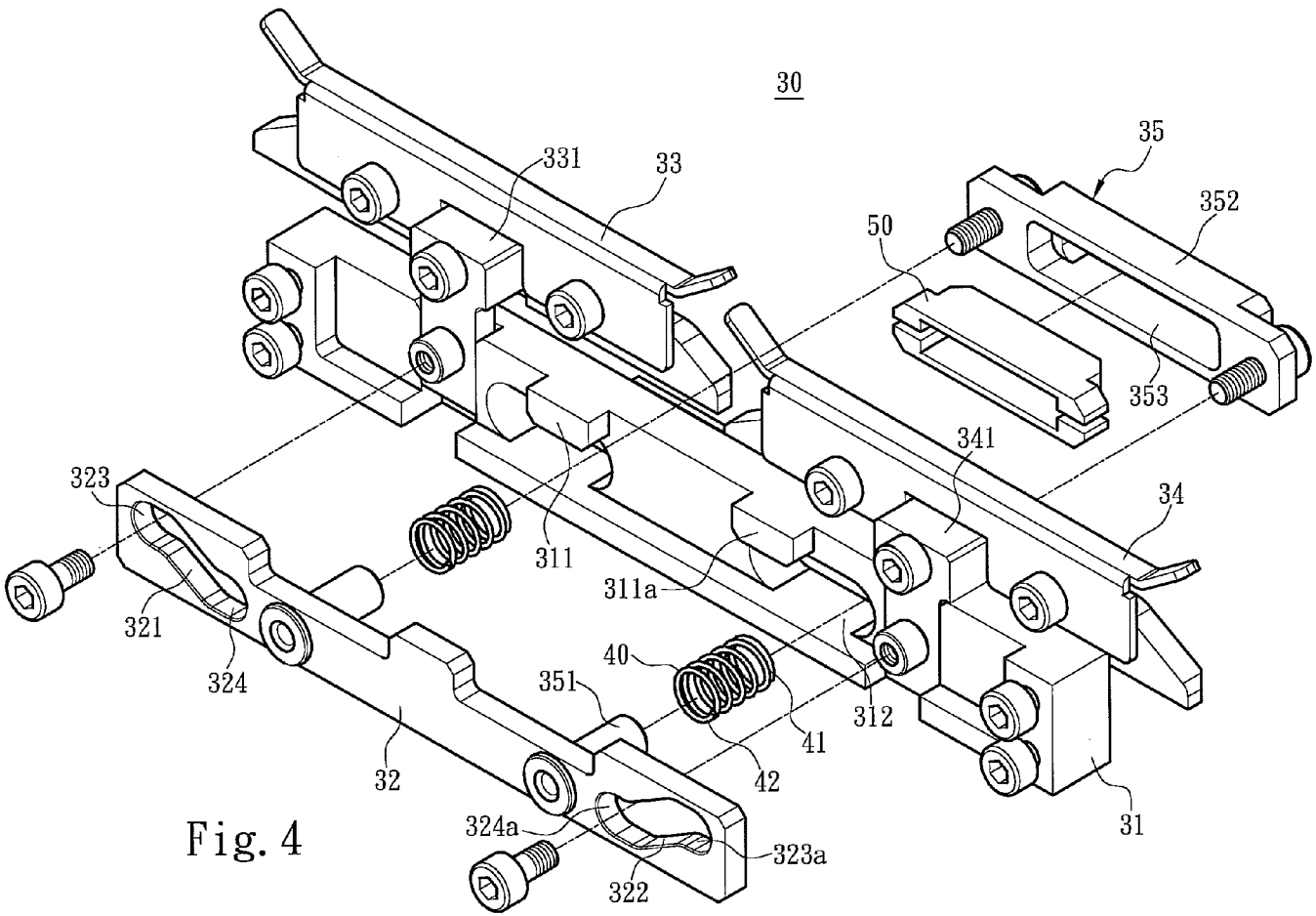
FIG. 4 is an exploded view of an embodiment of the invention.

Please referring to FIGS. 2, 3 and 4, the sinker control apparatus 30 is located on the transverse board 12 and coupled with the carrier (not shown in the drawings). The sinker control apparatus 30 includes a base 31, a linked movement portion 32 coupled on the base 31 to perform driving movements relative to the base 31, a first control cam 33 and a second control cam 34 hinged on the linked movement portion 32, and a switching portion 35 coupled on the linked movement portion 32. The base 31 has at least one restricting portion 311 and 311*a* to restrict the driving movements of the linked movement portion 32. When the linked movement portion 32 performs the driving movements the first control cam 33 and second control cam 34 are driven to a sunk position and a return position. At the sunk position the first control cam 33 or second control cam 34 pushes the control boss 222 of the sinker 22 so that the sinker 22 rotates and the downward pressing boss 221 makes a yarn to form a loop. At the return position the first control cam 33 or second control cam 34 draws the control boss 222 to rotate the sinker 22 backwards so that the downward pressing boss 221 returns to its original position. Referring to FIGS. 1 and 4, the switching portion 35 includes at least one connection rod 351 connected to the linked movement portion 32 and a switching seat 352 coupled on the connection rod 351. In this embodiment the connection rod 351 runs through the linked movement portion 32 in a movable manner so that the switching portion 35 is movable against the linked movement portion 32. Or the switching seat 352 may also be movably coupled on the connection rod 351 so that the switching seat 352 is movable on the connecting rod 351. The base 31 includes at least one slot 312 run through by the connection rod 351 to couple with the linked movement portion 32 and switching seat 352. The switching seat 352 has a magnetic attracting portion 50 at one side facing the transverse board 12 to form magnetic attraction therewith. The magnetic attracting portion 50 can be a magnet. The switching seat 352 has a trough 353 to hold the magnetic attracting portion 50.

The first and second control cams 33 and 34 have respectively a first driving rod 331 and a second driving rod 341. The linked movement portion 32 has a first guide track 321 and a second guide track 322 run through respectively by the first driving rod 331 and second driving rod 341 to guide movements thereof to switch the first control cam 33 and second control cam 34 between the sunk position and return position. The first guide track 321 has a first pushing section 323 to push the first driving rod 331 to drive the first control cam 33 to the sunk position and a first restoring section 324 to draw the first driving rod 331 to drive the first control cam 33 back to the return position. The first pushing section 323 and first restoring section 324 are at different planes. Similarly, the second guide track 322 also has a second pushing section 323*a* to push the second driving rod 341 to drive the second control cam 34 to the sunk position and a second restoring section 324*a* to draw the second driving rod 341 to drive the second control cam 34 back to the second return position. The second pushing section 323*a* and second restoring section 324*a* are at different planes.

Figure 5:
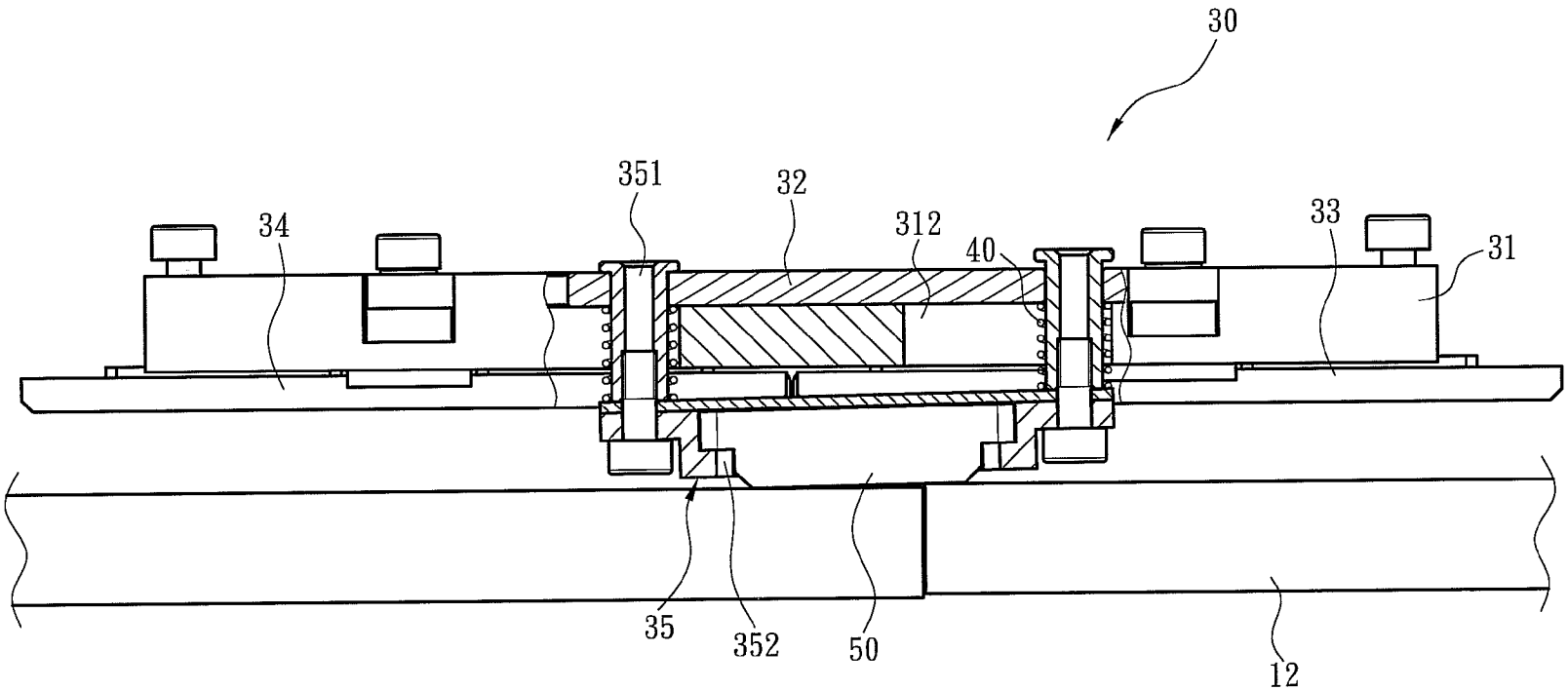
FIG. 5 is a schematic view of the switching portion of an embodiment moved to the transverse board at different levels.

In this invention, the switching portion 35 further includes an elastic element 40 coupled around the connection rod 351. The elastic element 40 has a first end 41 butting the switching seat 352 and a second end 42 butting the linked movement portion 32. In this embodiment the elastic element is a spring. When the switching portion 35 is moved at a position at a section difference relative to the transverse board 12, as shown in FIG. 5, the first end 41 and second end 42 of the elastic element 40 press respectively the switching seat 352 and linked movement portion 32 to give the switching seat 352 a butting force towards the transverse board 12 so that the switching seat 352 and the transverse board 12 are maintained in a desired contact relationship without forming too much distance to make driving the switching seat 352 not possible, or squeezing between the switching seat 352 and transverse board 12 to make transverse movement of the switching seat 352 not possible.

Figure 6A:
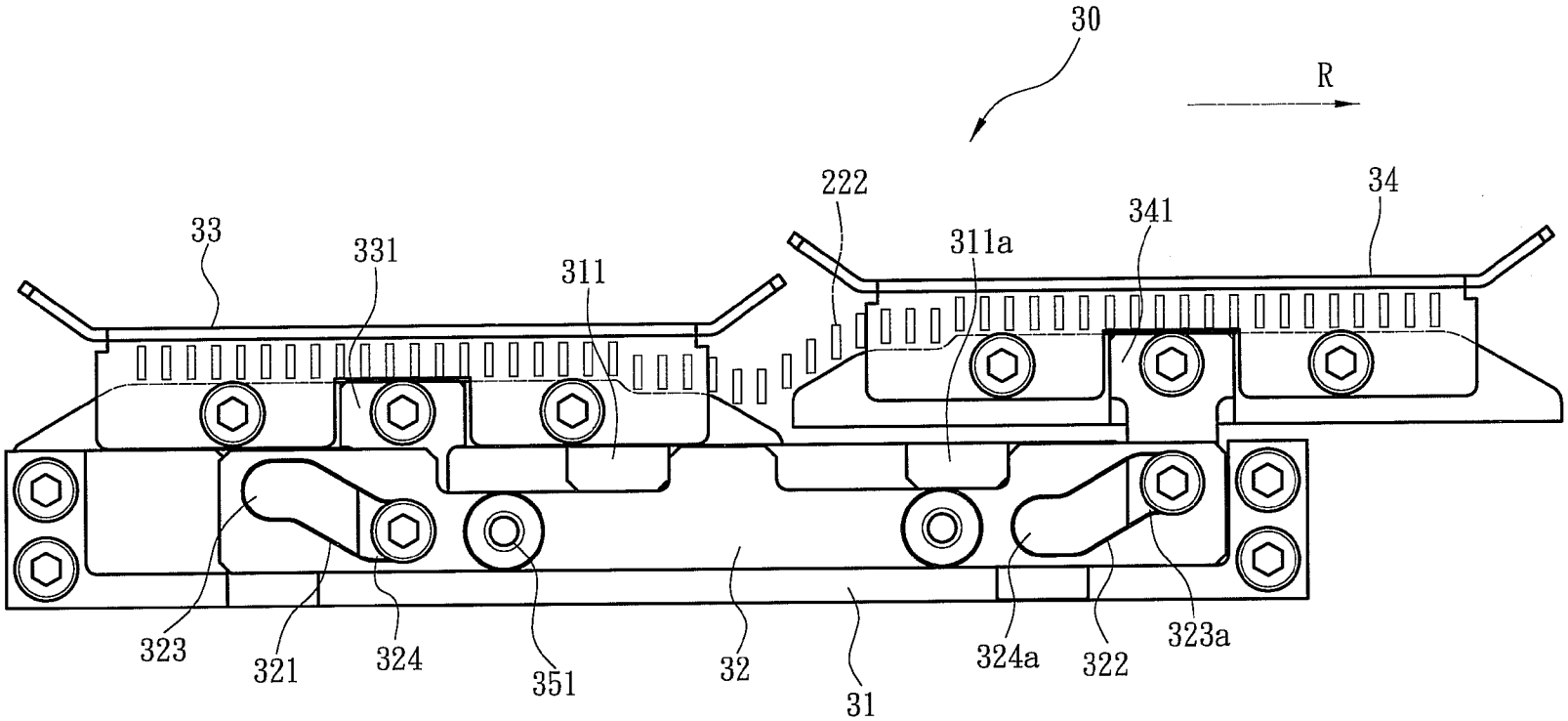
FIGS. 6A and 6B are schematic views of an embodiment of the invention in operating conditions.
Figure 6B:
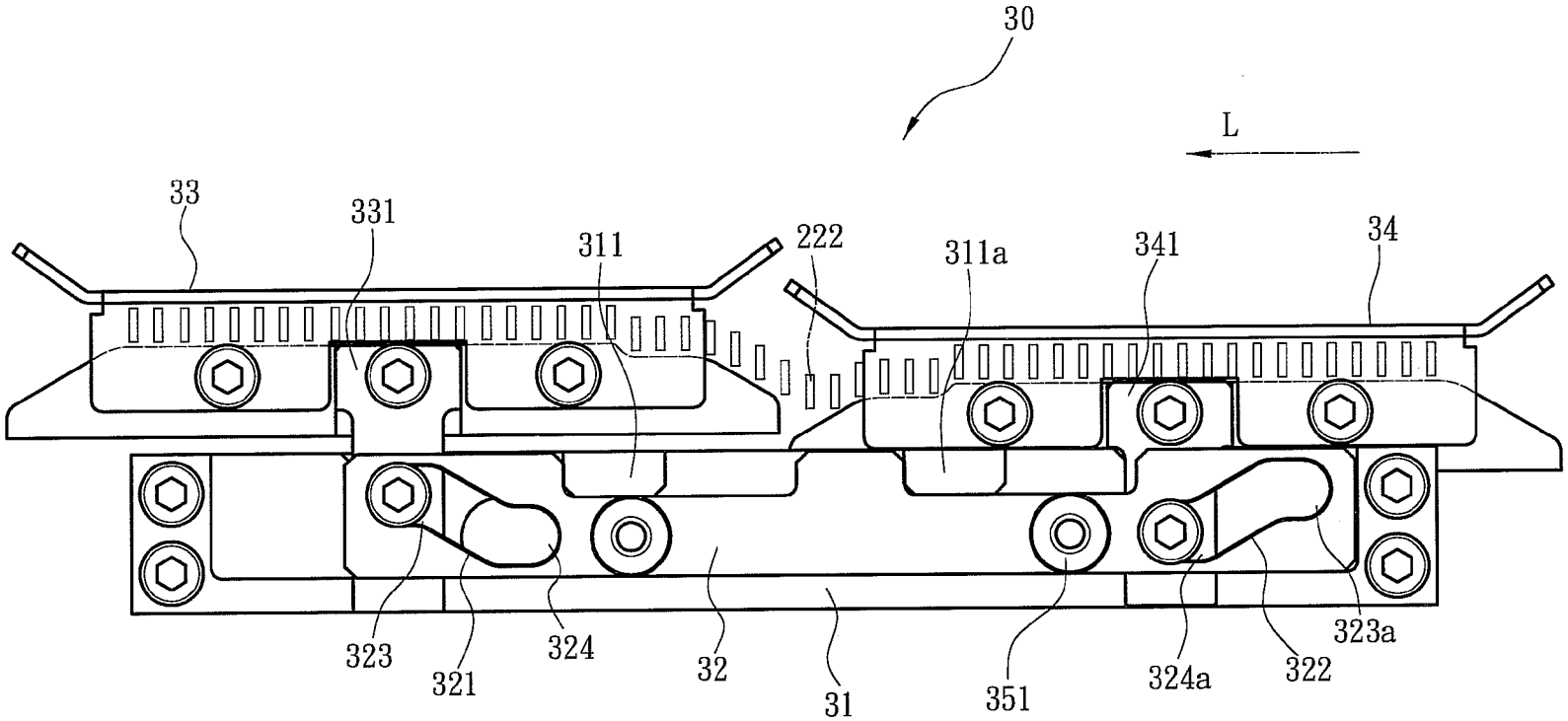

Please refer to FIGS. 6A and 6B for an embodiment of the invention in operating conditions. At the initial state, as shown in FIG. 6A, the magnetic attracting portion 50 of the switching seat 352 and the transverse board 12 attract each other magnetically to position the sinker control apparatus 30 on the transverse board 12, the first driving rod 331 of the first control cam 33 is at the first restoring section 324 of the first guide track 321 so that the first control cam 33 is at the return position, while the second driving rod 341 of the second control cam 34 is at the second pushing section 313*a* of the second guide track 322 to make the second control cam 34 at the sunk position.

When the sinker control apparatus 30 is moved in the direction R relative to the transverse board 12, at the initial moving period because of mutual magnetic attraction between the magnetic attracting portion 50 of the switching seat 352 and transverse board 12 only the base 31 and the first and second control cams 33 and 34 located thereon are moved in the direction R; the first driving rod 331 of the first control cam 33 moves from the first restoring section 324 of the first guide track 321 to the first pushing section 323 so that first control cam 33 also is switched from the return position to the sunk position, meanwhile, the second driving rod 341 of the second control cam 34 moves from the second pushing section 323*a* of the second guide track 322 to the second restoring section 324*a* so that the second control cam 34 is switched from the sunk position to the return position as shown in FIG. 6B. With the movements continued, the first driving rod 331 and second driving rod 341 drive the linked movement portion 32 and switching portion 35 located thereon to proceed a driving movement relative to the base 31 until the linked movement portion 32 hitting the restricting portion 311.

Thereafter, if moving the sinker control apparatus 30 in the direction L relative to the transverse board 12 is intended, in the initial moving period, because of mutual magnetic attraction between the magnetic attracting portion 50 of the switching seat 352 and transverse board 12 only the base 31 and the first and second control cams 33 and 34 located thereon are moved in the direction L; the first driving rod 331 of the first control cam 33 moves from the first pushing section 323 of the first guide track 321 to the first restoring section 324 so that first control cam 33 is switched from the sunk position to the return position, meanwhile, the second driving rod 341 of the second control cam 34 moves from the second restoring section 324*a* of the second guide track 322 to the second pushing section 323*a* so that the second control cam 34 is switched from the return position to the sunk position as shown in FIG. 6A. With the movements continued, the first driving rod 331 and second driving rod 341 drive the linked movement portion 32 and switching portion 35 located thereon to proceed a driving movement relative to the base 31 until the linked movement portion 32 hitting another restricting portion 311*a*.

As a conclusion, the sinker control apparatus of the invention can maintain the switching seat and the transverse board in a desired contact relationship to stabilize the movement condition of the sinker control apparatus relative to the transverse board, thereby can switch the control cams between the sunk position and return position as desired. Moreover, the linked movement portion is constructed simpler than the conventional cam-driving one, thus can be fabricated and assembled easier to reduce production cost. It provides a significant improvement over the conventional techniques.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A sinker control apparatus for flat knitting machines located on a transverse board over a plurality of knitting needles to drive parallel hinged sinkers between the knitting needles to rotate, comprising:

a base;

a linked movement portion located on the base to perform driving movements relative to the base;

a first control cam and a second control cam that are hinged on the linked movement portion and include respectively a sunk position to drive the sinkers to rotate and a return position to restore the sinkers when the linked movement portion performs the driving movements; and a switching portion which includes at least one connection rod connected to the linked movement portion, a switching seat coupled on the connection rod and an elastic element coupled around the connection rod to provide a butting force to the switching seat towards the transverse board, the switching seat including a magnetic attracting portion at one side facing the transverse board to form magnetic attraction therewith.

2. The sinker control apparatus of claim 1, wherein the base includes at least one slot run through by the connection rod coupling with the linked movement portion and the switching seat.

3. The sinker control apparatus of claim 1, wherein the first control cam and the second control cam include respectively a first driving rod and a second driving rod, the linked movement portion including a first guide track and a second guide track run through respectively by the first driving rod and the second driving rod to guide movements thereof to switch the first control cam and the second control cam between the sunk position and the return position.

4. The sinker control apparatus of claim 3, wherein the first guide track includes a first pushing section to push the first driving rod to drive the first control cam to the sunk position and a first restoring section to draw the first driving rod to drive the first control cam back to the return position, the first pushing section and the first restoring section being located not on a same plane.

5. The sinker control apparatus of claim 3, wherein the second guide track includes a second pushing section to push the second driving rod to drive the second control cam to the sunk position and a second restoring section to draw the second driving rod to drive the second control cam back to the return position, the second pushing section and the second restoring section being located not on a same plane.

6. The sinker control apparatus of claim 1, wherein the switching seat includes a trough to hold the magnetic attracting portion.

7. The sinker control apparatus of claim 1, wherein the elastic element includes a first end butting the switching seat and a second end butting the linked movement portion.

8. The sinker control apparatus of claim 1, wherein the magnetic attracting portion is a magnet.

9. The sinker control apparatus of claim 1, wherein the elastic element is a spring coupled around the connection rod.

10. The sinker control apparatus of claim 1, wherein the base includes at least one restricting portion to restrict the driving movements of the linked movement portion.

* * * * *